US006393792B1

(12) United States Patent
Mowery et al.

(10) Patent No.: US 6,393,792 B1
(45) **Date of Patent: *May 28, 2002**

(54) SPLICING MEMBER FOR SIDING PANELS

(75) Inventors: Jack T. Mowery, Medina; Benjamin L. McGarry, Akron, both of OH (US)

(73) Assignee: Associated Materials, Incorporated, Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/496,496

(22) Filed: Feb. 2, 2000

Related U.S. Application Data

(63) Continuation-in-part of application No. 09/122,333, filed on Jul. 24, 1998, now Pat. No. 6,050,041.

(51) Int. Cl.[7] ..... E04B 2/02

(52) U.S. Cl. ..... 52/520; 52/506.05; 52/549; 52/551; 52/582.1; 52/712; 52/586.2

(58) Field of Search ..... 52/519, 520, 521, 52/523, 546, 549, 550, 551, 557, 582.1, 586.1, 586.2, 712, 506.05

(56) References Cited

U.S. PATENT DOCUMENTS

| | | | | | |
|---|---|---|---|---|---|
| 1,772,694 | A | * | 8/1930 | White | 52/519 X |
| 2,264,546 | A | * | 12/1941 | Ochs | 52/521 |
| 3,265,420 | A | * | 8/1966 | Goodrich | |
| 3,437,360 | A | * | 4/1969 | Gould et al. | 52/586.1 |
| 3,977,145 | A | * | 8/1976 | Dobby et al. | 52/531 |
| 4,272,576 | A | * | 6/1981 | Britson | 428/100 |
| 4,320,613 | A | * | 3/1982 | Kaufman | 52/521 |
| 4,432,181 | A | * | 2/1984 | Funaki | 52/459 |
| 4,736,565 | A | * | 4/1988 | Bisson | 52/519 X |
| 5,150,555 | A | * | 9/1992 | Wood | 52/544 |
| 5,349,802 | A | * | 9/1994 | Kariniemi | 52/543 |
| 5,461,839 | A | * | 10/1995 | Beck | 52/519 |
| 5,553,434 | A | * | 9/1996 | Tamura | 52/545 |
| 5,661,939 | A | * | 9/1997 | Coulis et al. | 52/519 |
| 5,675,955 | A | * | 10/1997 | Champagne | 52/520 X |
| 5,729,946 | A | * | 3/1998 | Beck | 52/519 X |
| 5,768,844 | A | * | 6/1998 | Grace, Sr. et al. | 52/529 |
| 5,794,396 | A | * | 8/1998 | Gibbs | 52/518 |
| 5,946,876 | A | * | 9/1999 | Grace, Sr. et al. | 52/520 |
| 6,050,041 | A | * | 4/2000 | Mowery et al. | 52/520 |
| 6,122,877 | A | * | 9/2000 | Henderickson et al. | 52/520 |
| 6,155,006 | A | * | 12/2000 | Mimura et al. | 52/520 X |

FOREIGN PATENT DOCUMENTS

| | | | | |
|---|---|---|---|---|
| GB | 753076 | * | 7/1956 | 52/519 |

* cited by examiner

*Primary Examiner*—Robert Canfield
(74) *Attorney, Agent, or Firm*—Banner & Witcoff, Ltd.

(57) ABSTRACT

A splicing member for joining horizontally adjacent and abutting siding panels installed on a structure has a declination being substantially planar and extending downwardly and slightly outwardly, a top lock, and a bottom lock. In certain preferred embodiments, the top lock is a flange connected to an upper edge of the declination forming a downwardly opening U-shaped channel which receives a portion of horizontally adjacent siding panels to which the splicing member is attached. In certain preferred embodiments, the bottom lock is a shoulder extending inwardly and substantially horizontally from a lower edge of the declination. When installed, the splicing member is positioned behind two horizontally adjacent and abutting siding panels and a fastener or weld rigidly secures the siding panels and the splicing member to one another. A splicing member having multiple declinations to fixedly secure horizontally adjacent siding panels to one another and having multiple declinations is also disclosed.

15 Claims, 10 Drawing Sheets

SPLICING MEMBER FOR SIDING PANELS

RELATED APPLICATIONS

This application is a continuation-in-part application of application Ser. No. 09/122,333, filed on Jul. 24, 1998 and which is now U.S. Pat. No. 6,050,041.

INTRODUCTION

The present invention is directed to siding panels, and, more particularly, to a splicing member for securing horizontally adjacent siding panels to one another.

BACKGROUND

Siding, or wall siding, is commonly used to cover the exterior walls of structures. Wall siding is often formed of metal such as aluminum or a thermoplastic material such as polyvinyl chloride (PVC), which is commonly referred to as vinyl siding. The siding is typically formed with declinations, that is, downwardly and outwardly extending flat portions, which combine with horizontal shoulders to form a clapboard profile.

The siding is installed in multiple horizontal rows of panels, each row typically consisting of multiple overlapping panels and each row overlapping the row below and to which it is adjacent. Adjoining panels are overlapped in this manner to provide protection for the structure from the elements. The vertical edges of panels which overlap horizontally adjacent panels tend to separate from the overlapped panel, forming unsightly gaps between horizontally adjacent panels.

Another problem encountered in the installation of siding panels is their rate of expansion and contraction. Vinyl siding panels have a relatively high thermal coefficient of expansion, on the order of $4.5\times10^{-5}$. Therefore, for a typical 12' long panel, there can be a variance in its length of up to ¾". By overlapping horizontally adjacent panels, this variance can be accommodated. However, as indicated above, the separation of the overlapped panels decreases the aesthetic appeal of the siding.

One solution to the problem of separation of overlapped seams provides siding panels manufactured as a long continuous panel, avoiding the need for seams between horizontally adjacent panels. These panels may be as large as 40' in length. Panels of this length have proven to be very difficult to handle, store, and transport. The siding panels are relatively thin, and, therefore, quite flexible. Typically, three to five individuals are required to handle a single panel of this length. The standard length of a panel is approximately 12', and the siding panel industry is accustomed to dealing with panels of this size. The shelving, trucks, trailers, and other transportation devices used to store and handle siding are generally designed to accommodate standard 12' panels. Panels larger than the standard 12' length, which, as noted above, can be up to 40' long, create inventory and handling problems since very large shelving and or other storage areas must be provided to store panels of this length. Transportation of panels of this length is also problematic since special trailers and other transporting equipment may be required for delivery of the panels. These problems result in increased storage and handling costs, making such long panels very expensive to install.

It is an object of the present invention to provide a splicing member for connecting horizontally adjacent siding panels which reduces or wholly overcomes some or all of the aforesaid difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY OF THE INVENTION

The principles of the invention may be used to advantage to provide a splicing member extending behind and securely fastening horizontally adjacent siding panels to one another.

In accordance with a first aspect, a splicing member for securing horizontally adjacent siding panels to one another in an abutting relationship has a declination having an upper edge and a lower edge. A flange is connected to the upper edge of the declination forming a downwardly opening U-shaped channel to receive a portion of each of the two horizontally adjacent siding panels. A shoulder extends inwardly from the lower edge of the declination. Each of a pair of fasteners secures a portion of the splicing member to one of the siding panels, the splicing member being positioned behind the siding panels.

In accordance with another aspect, a splicing member for securing horizontally adjacent siding panels to one another in an abutting relationship has an upper declination having an upper edge and a lower edge. A flange member is connected to the upper edge of the upper declination forming a downwardly opening U-shaped upper channel to receive a portion of each of the horizontally adjacent siding panels behind which the splicing member is positioned. A lower declination has an upper edge and a lower edge, and an upper shoulder extends inwardly between the lower edge of the upper declination and the upper edge of the lower declination. A lower shoulder extends inwardly from the lower edge of the lower declination, and each of a pair of fasteners secures a portion of the splicing member to the siding panels.

In accordance with yet another aspect, a splicing member for securing horizontally adjacent siding panels to one another in an abutting relationship has a plurality of declinations, each declination having an upper edge and a lower edge. A flange is connected to the upper edge of the uppermost declination forming a downwardly opening U-shaped channel to receive a portion of each of two horizontally adjacent siding panels. A shoulder extends inwardly and substantially horizontally from the lower edge of each declination, and each of pair of fasteners secures a portion of the splicing member to one of the siding panels, the splicing member being positioned behind the siding panels when they are installed.

In accordance with another aspect, a splicer for siding panels has a pair of horizontally adjacent siding panels, each panel having an upper panel declination having an upper edge and a lower edge, and a lower panel declination having an upper edge and a lower edge. An upper panel shoulder extends inwardly between the lower edge of the upper panel declination and the upper edge of the lower panel declination. A projection is formed between an inner edge of the upper panel shoulder and the upper edge of the lower panel declination. A lower panel shoulder extends inwardly from the lower edge of the lower panel declination and terminates in a lip extending upwardly from an innermost edge of the lower panel shoulder. A splicing member has an upper splicing member declination having an upper edge and a lower edge, and a flange connected to the upper edge of the upper splicing member declination forming a downwardly opening upper channel to receive a portion of the siding panels. A lower splicing member declination has an upper edge and a lower edge. An upper splicing member shoulder extends inwardly between the lower edge of the upper splicing member declination and the upper edge of the lower splicing member declination. A downwardly opening lower channel is formed between the upper splicing member shoulder and the upper edge of the lower splicing member declination, the downwardly opening lower channel receiving the projections of the siding panels. A lower splicing member shoulder extends inwardly from the lower edge of the lower splicing member declination and each of a pair of fasteners secures a portion of the splicing member to one of the siding panels, the splicing member being positioned behind the siding panels when secured thereto. A retaining member secures the siding panels to a desired surface.

In accordance with yet another aspect, a splicing member for securing horizontally adjacent siding panels to one another in an abutting relationship has a declination having an. upper edge and a lower edge. An upper engaging member mates with a portion of each of two horizontally adjacent siding panels, and a lower engaging member mates with a portion of each of the two siding panels. Each of a pair of fasteners secures a portion of the splicing member to one of the siding panels, the splicing member being positioned behind the siding panels.

From the foregoing disclosure, it will be readily apparent to those skilled in the art that the present invention provides a significant technological advance. Substantial advantage is achieved by providing splicing members for securing horizontally adjacent siding panels to one another. In particular, the appearance of the siding is improved. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
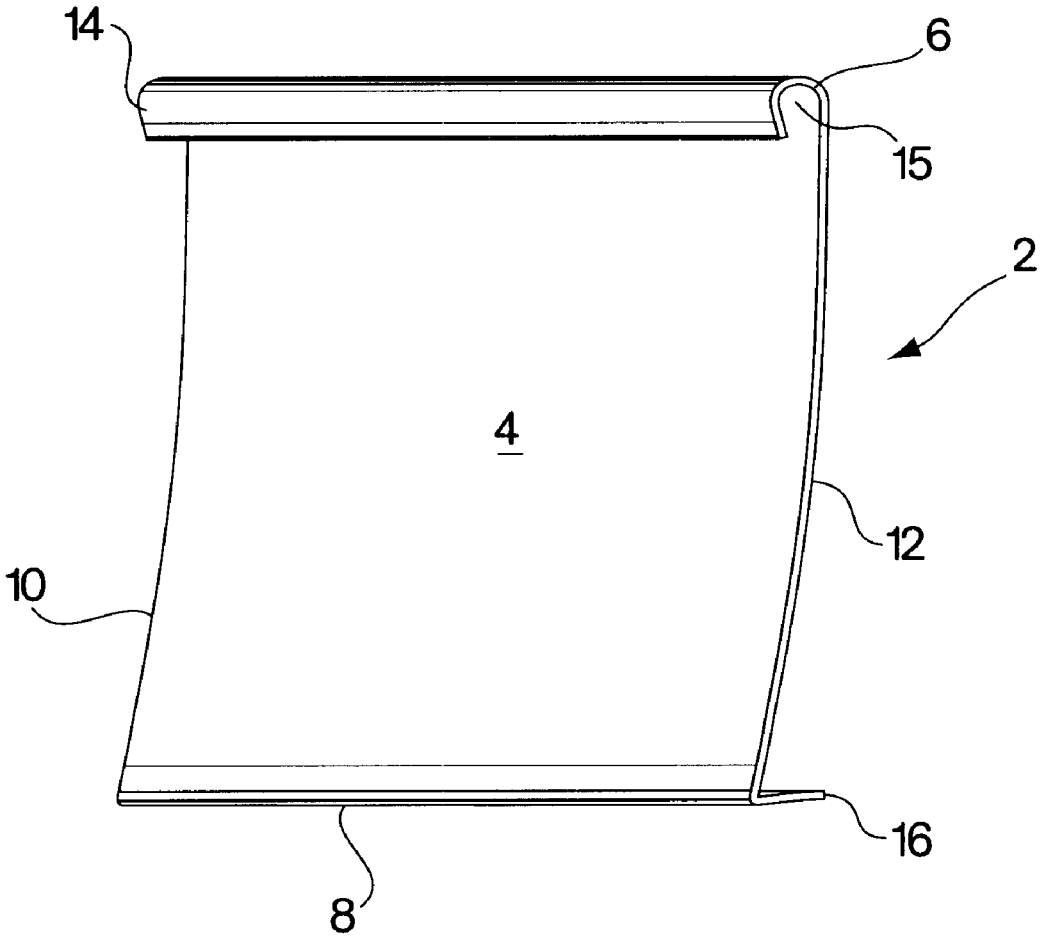
FIG. 1 is a schematic perspective view of a splicing member of the present invention.

The figures referred to above are not drawn to scale and should be understood to present a simplified representation of the invention, illustrative of the basic principles involved. Some features of the splicing member depicted in the drawings have been enlarged or distorted relative to others to facilitate explanation and understanding. The same reference numbers are used in the drawings for similar or identical components and features shown in various alternative embodiments. The splicing member, as disclosed herein, will have configurations and components determined, in part, by the intended application and environment in which it is used.

DETAILED DESCRIPTION OF CERTAIN PREFERRED EMBODIMENTS

Unless otherwise stated, or otherwise clear from the context below, directional references used here are based on the orientation of components and assemblies shown in the appended drawings. These directional references assume wall siding attached to the walls of a structure such as a house. These directional references are given in reference to the surface plane, such as the ground, upon which the structure sits, and the plane of the wall of the structure itself. Horizontal, therefore, refers to a direction which is substantially parallel to the surface plane. Vertical refers to a direction which is substantially parallel to the wall of the structure and substantially perpendicular to the surface plane. Outwardly refers to a direction moving substantially horizontally away from the structure upon which the siding is attached while inwardly refers to a direction moving substantially horizontally toward the structure. Downwardly refers to a direction moving substantially vertically toward the surface plane and upwardly refers to a direction moving substantially vertically away from the surface plane. Lower and upper refer to vertical directions with lower being closer to the surface plane than upper. Left and right are in reference to directions given when one is looking at the structure.

A first preferred embodiment of a splicing section, splicing member, or splicer 2, is shown in FIG. 1. Splicer 2 comprises a declination 4, having upper edge 6, lower edge 8, left vertical edge 10 and right vertical edge 12. The term declination, when used herein, refers to a substantially planar portion of a splicer which slopes downwardly and slightly outwardly from an upper edge thereof. Splicer 2 has a top lock and a bottom lock. The top and bottom locks can have a wide range of shapes, and are configured to interlock with top locks and bottom locks, respectively, of horizontally adjacent siding panels as described in detail below. In a preferred embodiment, the top lock comprises a flange 14 and the bottom lock comprises a shoulder 16. Flange 14 is formed along upper edge 6 of declination 4, projecting along the front of declination 4 and forming a downwardly opening U-shaped channel 15 along the length of splicer 2. In a preferred embodiment, channel 15 and flange 14 are formed by folding over an upper portion of declination 4. Shoulder 16 extends inwardly from lower edge 8 of declination 4. In a preferred embodiment, shoulder 16 has a downwardly opening concave profile.

Figure 2:
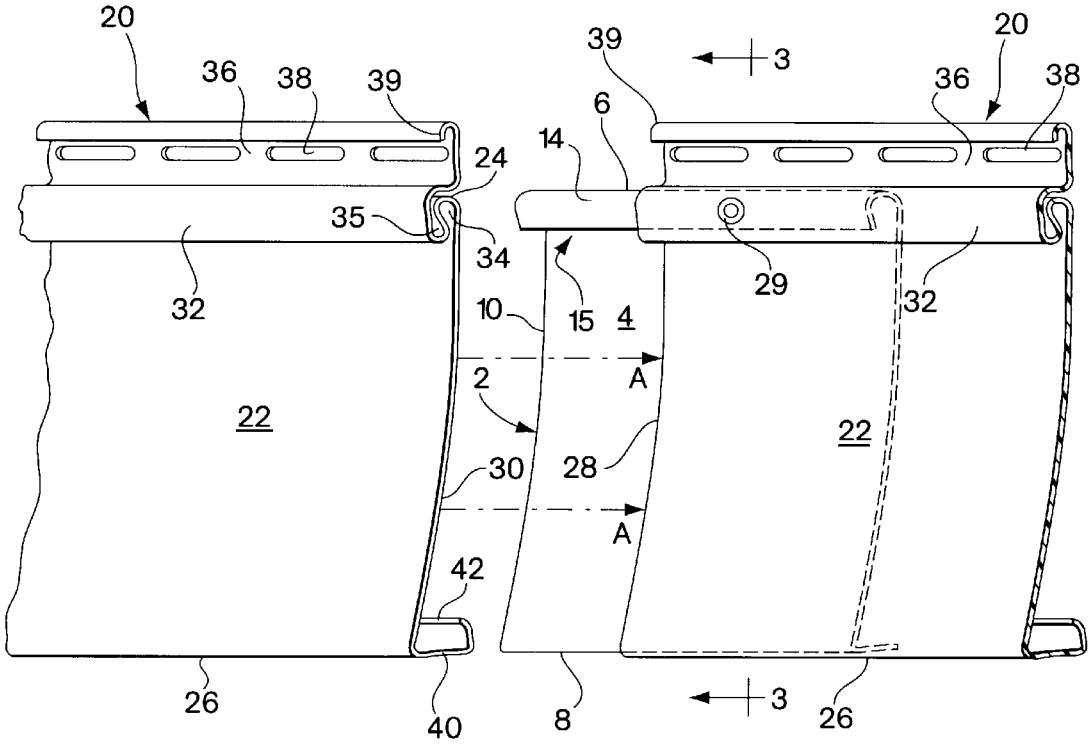
FIG. 2 is a schematic section view, shown partially cut away, of a splicing member of the present invention secured to a first siding panel, and a second siding panel shown prior to being secured to the splicing member adjacent the first siding panel.
Figure 3:
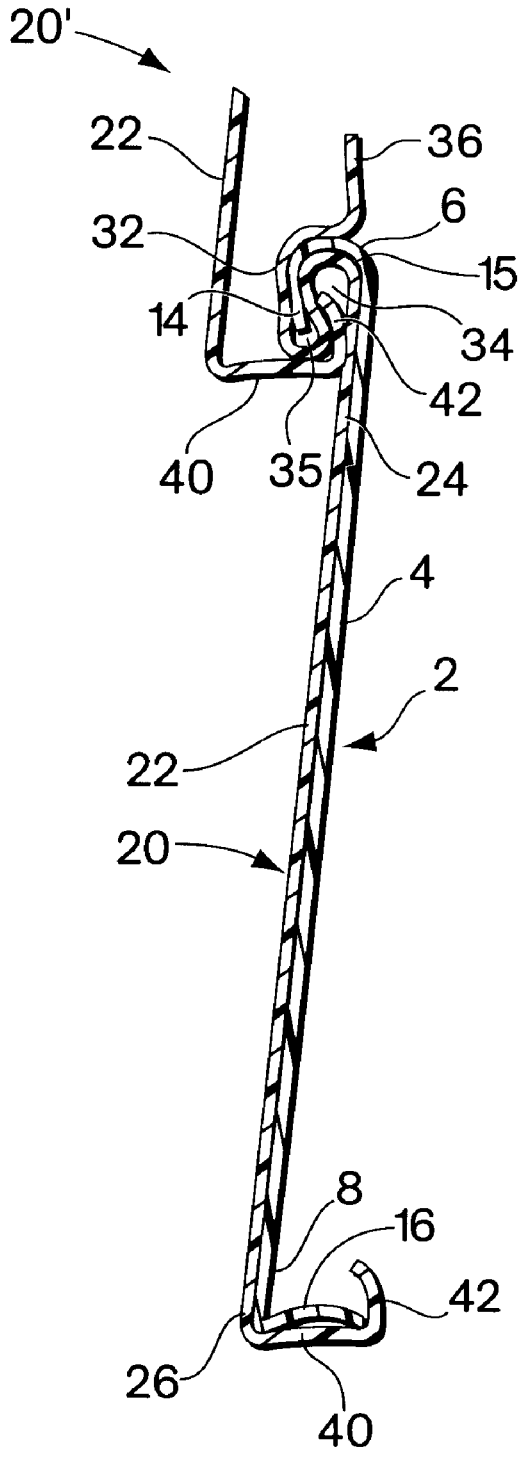
FIG. 3 is a schematic section view, shown partially cut away, of the splicing member of FIG. 1 positioned behind a siding panel, and a vertically adjacent siding panel overlapping the siding panel.

Turning now to FIGS. 2 and 3, splicer 2 can be seen in use with a pair of horizontally adjacent siding panels 20. Siding panels 20 can have a wide variety of configurations, but preferably include one or more declinations separated by a shoulder, a top lock, and a bottom lock. The top and bottom locks can also have a wide range of shapes. The top and bottom locks of panel 20 are configured to have complimentary shapes so that vertically adjacent siding panels can be interlocked in a known manner. In the illustrated embodiment, each siding panel 20 comprises a panel declination 22 having an upper edge 24, a lower edge 26, and left and right vertical edges 28, 30, respectively. The top lock comprises a panel flange 32, and the bottom lock comprises a panel shoulder 40.

Panel flange 32 extends along upper edge 24 of declination 22, preferably forming a downwardly opening U-shaped channel 34 along upper edge 24, and an upwardly opening channel 35 outwardly of channel 34 along the length of panel 20. Nailing hem 36 extends along the upper edge of panel 20. In a typical, or standard, siding panel, nails are driven through slots 38 formed in nailing hem 36 to secure the panels to a desired structure. The manner of securing of panels 20 of the present invention to a structure is discussed in greater detail below. Panel shoulder 40 extends inwardly and preferably substantially horizontally from lower edge 26, terminating in panel lip 42. Panel lip 42 extends substantially upwardly while curving slightly outwardly from an innermost edge of panel shoulder 40. In certain preferred embodiments, the upper edge of siding panel 20 curves forwardly and downwardly, terminating in upper lip 39.

Splicer 2 is positioned behind a first of the panels 20 (the rightmost panel 20 in the embodiment depicted in FIG. 2) such that flange 14 of splicer 2 is received by channel 35, and upper edge 24 of panel 20 is received by channel 15 of splicer 2. Shoulder 16 of splicer 2 is positioned above panel shoulder 40 and captured between lower edge 26 and lip 42 of panel 20. Thus, splicer 2 and panel 20 slidingly engage one another in an interlocking manner. Splicer 2 is rigidly secured to panel 20 by fastener 29, or multiple fasteners 29. In a preferred embodiment, fastener 29 is a rivet, but may be a screw, glue, or other suitable fastening means which will rigidly secure splicer 2 to siding panel 20.

Figure 11:
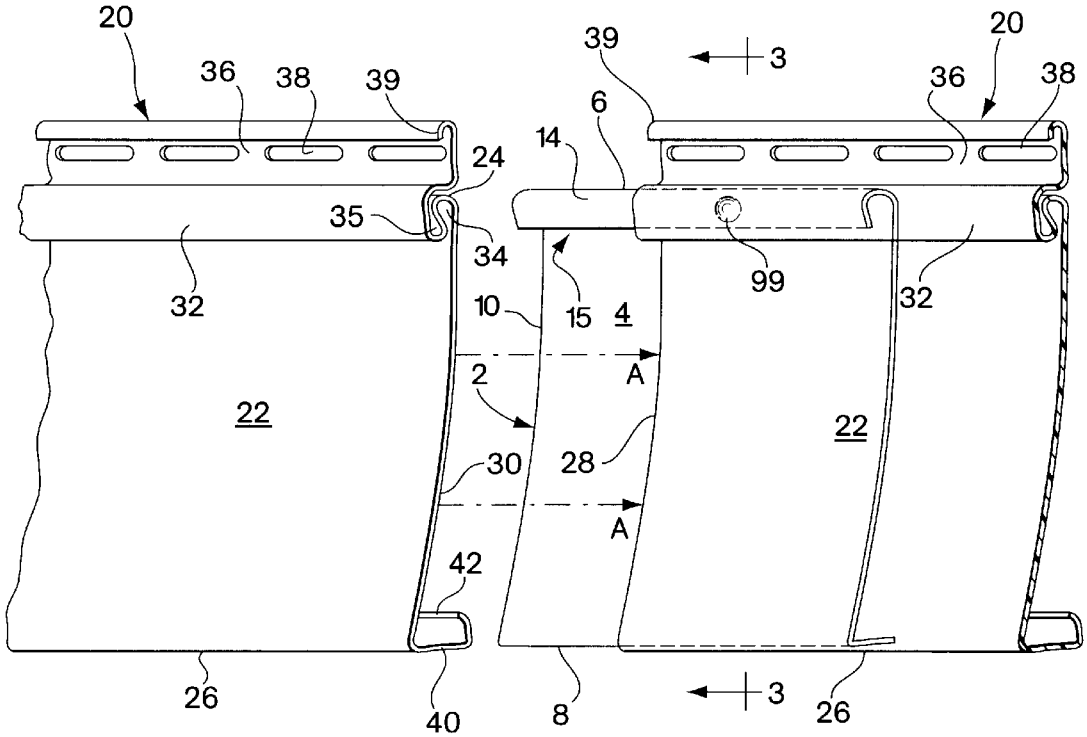
FIG. 11 is a schematic section view, shown partially cut away, of a splicing member of the present invention secured to a first siding panel in an alternative manner, and a second siding panel shown prior to being secured to the splicing member adjacent the first siding panel.

In another preferred embodiment, shown in FIG. 11, splicer 2 may be secured to siding panels 20 by weld 99. An advantage of welding is that the number of components is reduced, that is, no separate fasteners are required to attach splicer 2 to siding panels 20. Additionally, welding may provide a structurally superior joint between splicer 2 and siding panels 20. In use, a surface of flange 14 is welded to a surface of panel flange 32 by a welding device. One suitable welding device for welding splicer 2 to siding panels 20 is a portable butane fired soldering, or welding gun, which is easily carried by an individual installing siding panels on a structure such as a house. The butane fired welding gun has a heated needle-point tip which is pushed through the welding surfaces of splicer 2 and siding panel 20 such that the heat from the tip creates weld 99. Other suitable welding devices are well known to those skilled in the art, e.g., those powered by electricity, and further discussion of such welding devices need not be provided here. Weld 99 may be, in other preferred embodiments, formed by other mechanical, or chemical, bonding techniques. Other suitable types of mechanical and chemical bonds to form weld 99, wherein splicer 2 is secured to siding panel 20 without a separate and distinct fastener, will become readily apparent to those skilled in the art, given the benefit of this disclosure.

The second panel 20 (the leftmost panel 20 in FIG. 2) is then moved in the direction of arrows A, slidingly engaging splicer 2 in a similar interlocking manner until right edge 30 of second panel 20 abuts left edge 28 of first panel 20. Splicer 2 is then secured to second panel 20 by fastener 29 in a manner similar to the first panel.

In a preferred embodiment, splicer 2 is formed of one-piece construction, that is, from a single piece of material. Such construction provides for improved manufacturability, reduced costs, reduced complexity and improved handling. Splicer 2 and panels 20 may be formed of, for example, rigid polyvinyl chloride (PVC) or other suitable materials which will become readily apparent to those skilled in the art, that is, those with knowledge or experience in this particular field, given the benefit of this disclosure. In a preferred embodiment, splicer 2 and panels 20 are formed of a sheet of PVC having a thickness of about 0.04 inches, and more preferably about 0.042 inches. It is to be appreciated that splicer 2 should be of a thickness to provide the necessary support for a joint between horizontally adjacent panels 20.

When horizontally adjacent siding panels are installed with the splicer of the present invention in an abutting manner, there is little to no discernible gap between the abutting edges of the panels. Since the panels and splicer are preferably formed of the same material, they will expand and contract at the same rate. This fact, along with the rigid connection between them, ensures that the abutting relationship of the first and second siding panels is maintained Thus, the present invention provides a near seamless appearance for the siding while using standard length panels, advantageously achieving savings in handling and storage costs compared to longer, non-standard length panels. Splicer 2, as noted above, is hidden from view, further increasing the aesthetically appealing near seamless appearance. This attachment method also avoids the overlap of first and second panels 20, thereby additionally increasing the aesthetic appeal of the siding by avoiding problematic gaps between horizontally adjacent overlapped panels.

As can be seen in FIG. 3, third siding panels 20' are then installed in an overlapping manner above the first and second siding panels 20. Lip 42 of third siding panel 20' is inserted in channel 34 in an interlocking manner such that the shoulder 40 of third siding panel 20' captures the lower edge of panel flange 32. Third siding panel 20' is then secured to horizontally adjacent siding panels in the manner described above. It is to be appreciated that the splicer of the present invention will secure horizontally adjacent siding panels to one another without impairing the ability of the siding panels of one horizontal course, or row, to be interlocked with a vertically adjacent course of siding panels.

Figure 4:
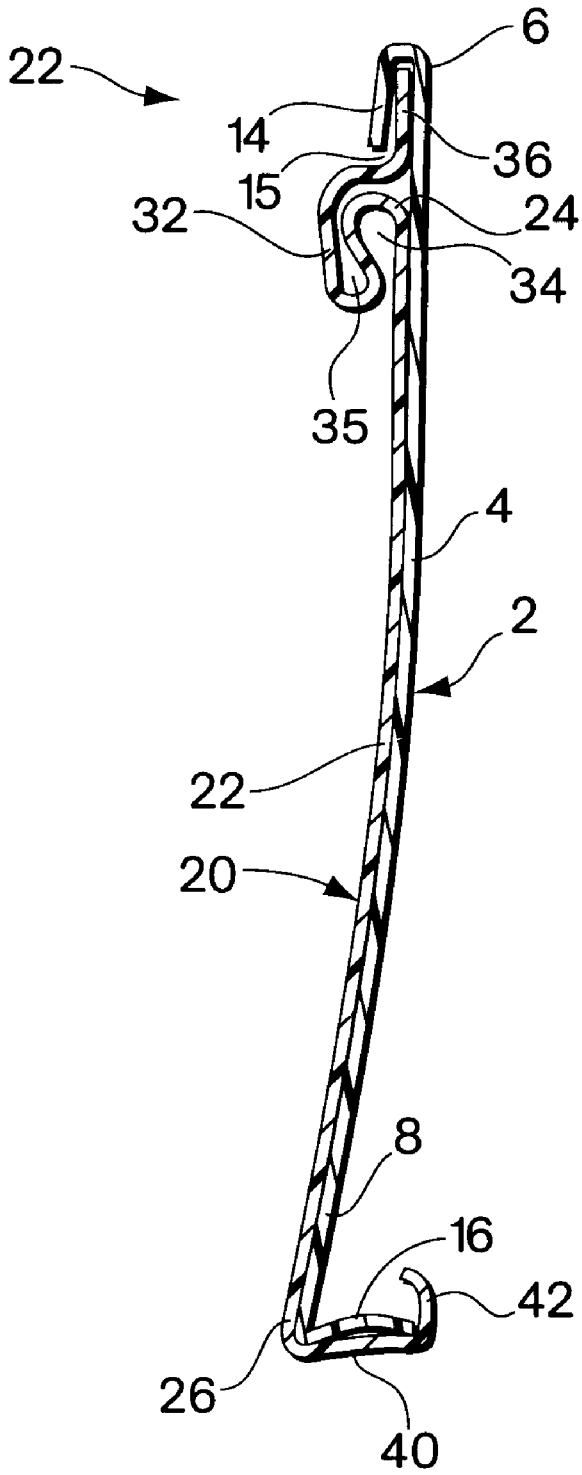
FIG. 4 is a schematic section view, shown partially cut away, of an alternative embodiment of the splicing member of the present invention positioned behind a siding panel.

In another preferred embodiment shown in FIG. 4, channel 15 of splicer 2 receives nailing hem 36 of siding panel 20 such that flange 14 extends along the front of siding panel 20. It is to be appreciated that in certain preferred embodiments, splicer 2 may be slightly curved along its declination, having an outwardly opening concave profile as seen in FIG. 4. In other preferred embodiments, as seen in FIG. 3, splicer 2 may be substantially planar.

Horizontally adjacent siding panels 20 which are secured to one another with a splicer according to the present invention are preferably secured to a structure in a manner which allows longitudinal expansion of the panels. Since the siding panels 20 and splicer 2 are rigidly secured to one another, they expand and contract as a single member, as described above. Thus, the entire attached length of multiple siding panels may expand and contract a significant amount, an amount which may not be adequately accommodated by slots 38 of nailing hem 36. A retaining member which can accommodate relatively large linear expansion is, therefore, preferably used to secure the siding panels to a structure. An example of a retaining member which can secure the siding panels to a structure while still allowing longitudinal movement of the panels is shown and described in U.S. Pat. No. 5,150,555 to Wood.

Figure 5:
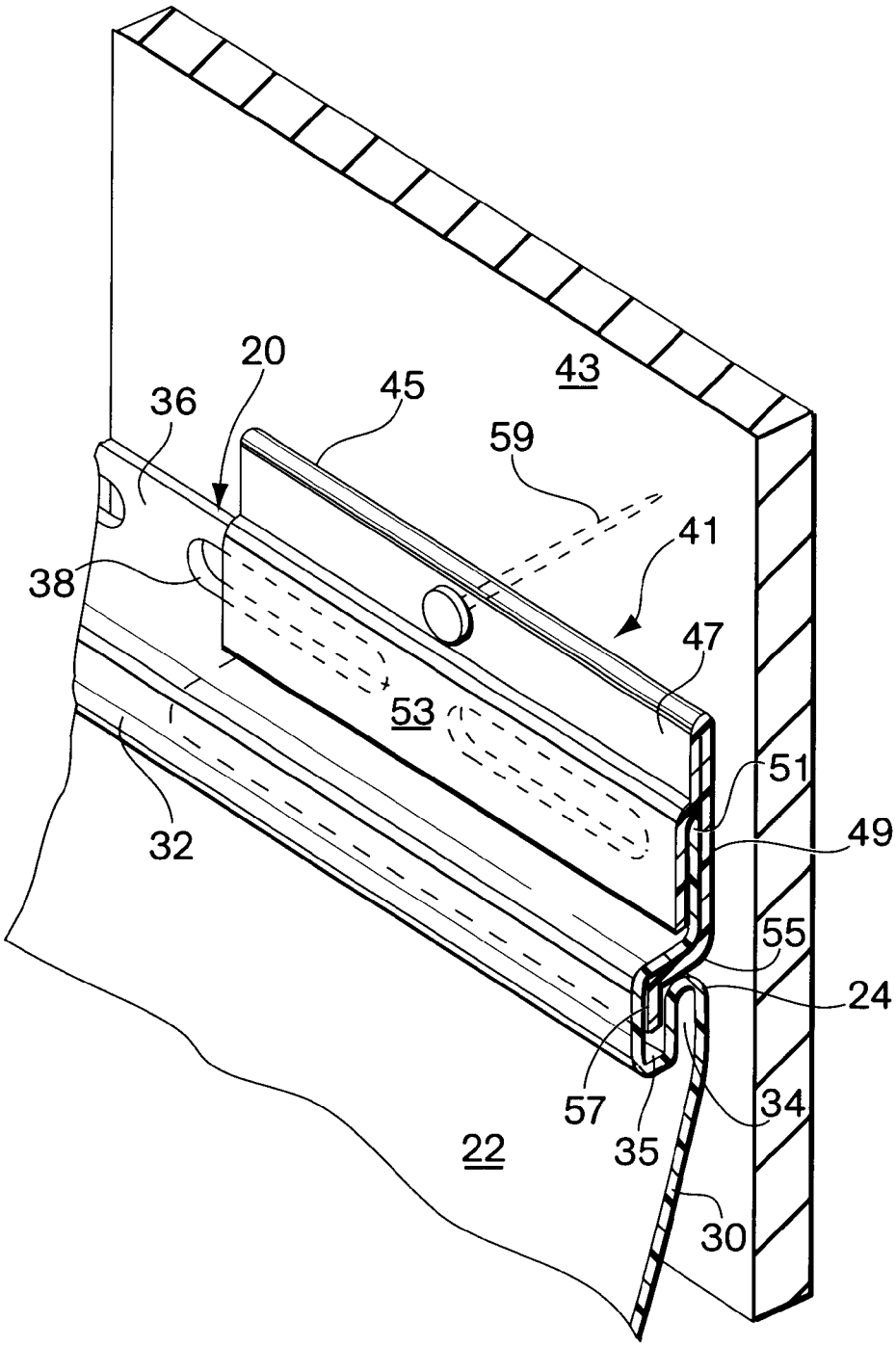
FIG. 5 is a schematic perspective view, shown partially cut away, of a siding panel and a retaining member of the present invention.

Clip 41, shown in FIG. 5, secures siding panels 20 to a structure 43. Clip 41 is preferably formed of a rectangular sheet of material folded to form an upper horizontal edge 45, with a forward leg 47 and a rearward leg 49 depending from upper edge 45. Forward leg 47 has the lower half thereof bent forwardly and thence downwardly parallel to rearward leg 49 to form a downwardly opening vertical slot 51. Rearward leg 49 depends downwardly past forward leg 47, and is bent forwardly slightly below the lower edge of lower half 53 of forward leg 47 to form a sloped shelf 55 which projects forwardly beyond lower half 53. Rearward leg 49 is then bent downwardly and parallel to forward leg 47 to form a depending flange 57.

In use, siding panel 20 is attached to surface 43 by sliding clip 41, or, in certain preferred embodiments, a plurality of clips 41, along the upper edge of siding panel 20. Nailing hem 36 is slidingly received by slot 51 of clip 41, and depending flange 57 is slidingly received by channel 35. Siding panel 20 is slidingly supported on sloped shelf 55 such that siding panel 20 may move longitudinally upon expansion and contraction due to changes in temperature. Clip 41 is then rigidly secured o structure 43 by nail 59 or another suitable fastener. The longitudinal width of clip 41 is preferably approximately four to five times the vertical height of the lower half 53 of forward leg 47, or vertical slot 51, to prevent clip 41 from rotating about nail 59 upon longitudinal movement of siding panel 20. Clip 41 may be formed of metal or other suitable materials which will allow siding panels 20 to be slidingly engaged by clip 41 while allowing clip 41 to be adequately secured to structure 43.

It is to be appreciated that the retaining member may be any suitable retaining device which slidably engages a portion of siding panel 20, allowing longitudinal movement of the panel to accommodate expansion and contraction of horizontally adjacent siding panels 20 and splicer 2, while ensuring that siding panels 20 and splicer 2 are adequately secured to structure 43.

Thus, it can be seen that slots 38 are not required for the installation of siding panels 20 installed in conjunction with a splicer 2. It is to be appreciated that nailing hem 36 may, therefore, be formed without slots 38, and may even be formed with a smaller vertical dimension, thus enabling siding panel 20 to be constructed with less material, further achieving cost savings.

Figure 6:
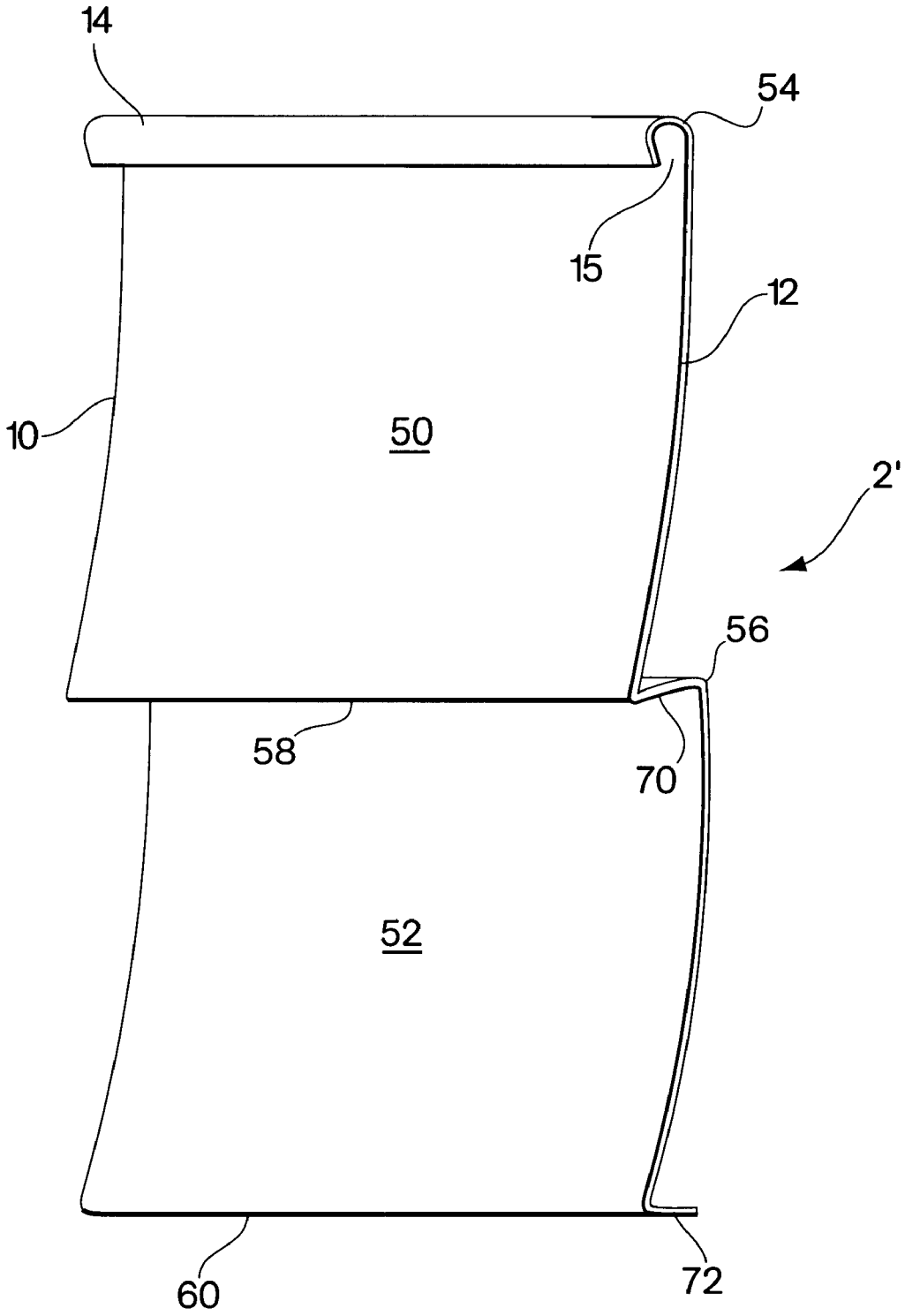
FIG. 6 is a schematic perspective view of an alternative embodiment of a splicing member of the present invention having two declinations.

In another preferred embodiment, a splicer of the present invention may be comprised of a plurality of declinations. As seen in FIG. 6, splicer 2' comprises upper declination 50 and lower declination 52, having upper edges 54, 56, respectively, lower edges 58, 60, respectively, and left and right vertical edges 10, 12. Flange 14 is formed along upper edge 54 of upper declination 50, projecting along the front of upper declination 50 and forming downwardly opening U-shaped channel 15 along the length of splicer 2'. Upper shoulder 70 extends inwardly and preferably substantially horizontally from lower edge 58 of upper declination 50 to meet upper edge 56 of lower declination 52. Lower shoulder 72 extends inwardly from lower edge 60 of lower declination 52. In a preferred embodiment, lower shoulder 72 has a downwardly opening concave profile.

Figure 7:
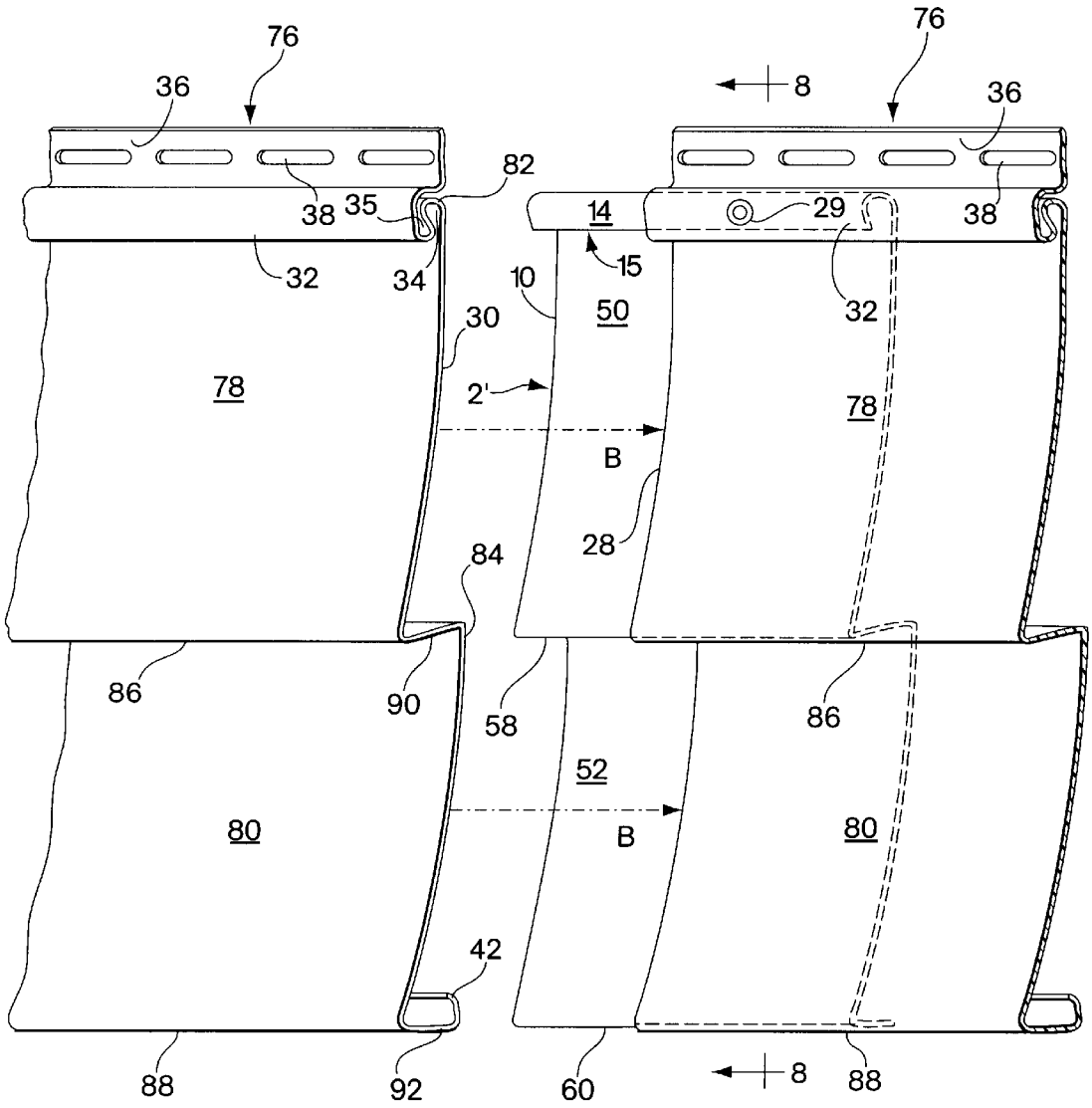
FIG. 7 is a schematic section view, shown partially cut away, of the splicing member of FIG. 6 secured to a first siding panel having two declinations, and a second siding panel having two declinations shown prior to being secured to the splicing member adjacent the first siding panel.
Figure 8:
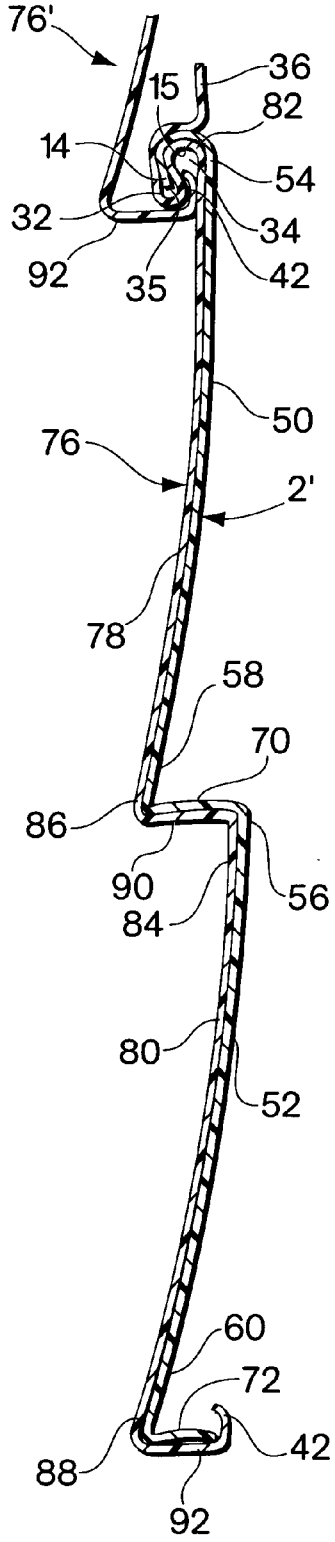
FIG. 8 is a schematic section view, shown partially cut away, of the splicing member of FIG. 6 positioned behind a siding panel having two declinations, and a vertically adjacent siding panel overlapping the siding panel.

Referring now to FIGS. 7 and 8, splicer 2' can be seen in use securing a pair of horizontally adjacent siding panels 76 to one another. Each siding panel 76 comprises an upper panel declination 78 and a lower panel declination 80, having upper edges 82, 84, respectively; lower edges 86, 88, respectively; and left and right vertical edges 28, 30, respectively. Panel flange 32 is formed along upper edge 82, preferably forming a downwardly opening U-shaped channel 34 along upper edge 82, and an upwardly opening channel 35 outwardly of channel 34 along the length of panel 76. Upper panel shoulder 90 extends inwardly and preferably substantially horizontally from lower edge 86 of upper panel declination 78, meeting upper edge 84 of lower panel declination 80. Lower panel shoulder 92 extends inwardly and preferably substantially horizontally from lower edge 88 of lower panel declination 80, terminating in panel lip 42. Panel lip 42 preferably extends substantially upwardly while curving slightly outwardly from an innermost edge of lower panel shoulder 92.

Splicer 2' is slidingly engaged with a first of the panels 76 (the rightmost panel 76 in the embodiment depicted in FIG. 7) such that flange 14 of splicer 2' is received by channel 35 of first panel 76, upper edge 82 of first panel 76 is received by channel 15 of splicer 2', and splicer 2' is positioned behind first panel 76. Shoulder 72 of splicer 2' is positioned above lower panel shoulder 92 of panel 76 and captured between lower edge 88 and lip 42 of first siding panel 76. Thus, splicer 2' and panel 76 slidingly engage one another in an interlocking manner. Splicer 2' and panel 76 are secured to one another via fastener 29. The second panel 76 (the leftmost panel 76 in FIG. 7) is then moved in the direction of arrows B over splicer 2' in a similar slidingly engaging interlocking manner until right edge 30 of second panel 76 abuts left edge 28 of first panel 76. Splicer 2' is then secured to second panel 76 by fastener 29 in a manner similar to first panel 76.

As can be seen in FIG. 8, third siding panels 76' are then installed in an overlapping manner above first and second siding panels 76. Lip 42 of third siding panel 76' is inserted in channel 34 such that lower shoulder 92 of third siding panel 76' captures the lower edge of flange 32. Third siding panel 76' is then secured to the structure and horizontally adjacent siding panels in the manner described above.

Figure 9:
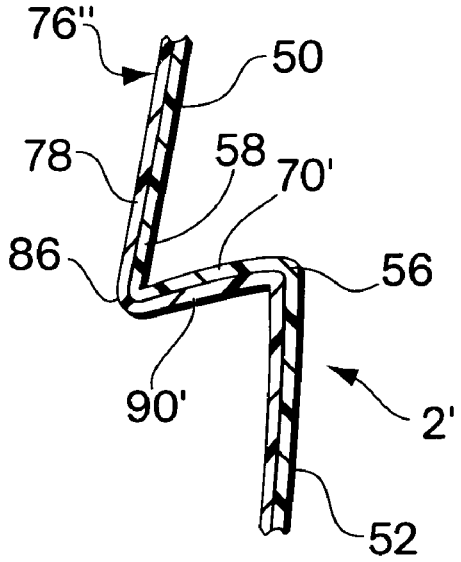
FIG. 9 is a schematic section view, shown partially cut away, of an alternative embodiment of the shoulder of the splicing member and siding panel of FIG. 7.

Another embodiment of the shoulder of the splicer having multiple declinations is shown partially broken away and in section in FIG. 9. In this illustrated embodiment, shoulder 70' of splicer 2' and upper shoulder 90' of panel 76" extend upwardly and inwardly from lower edges 58, 86, respectively. The mating engagement of inwardly and upwardly sloped shoulders 70', 90' provides further interlocking engagement between splicer 2' and panel 76".

Figure 10:
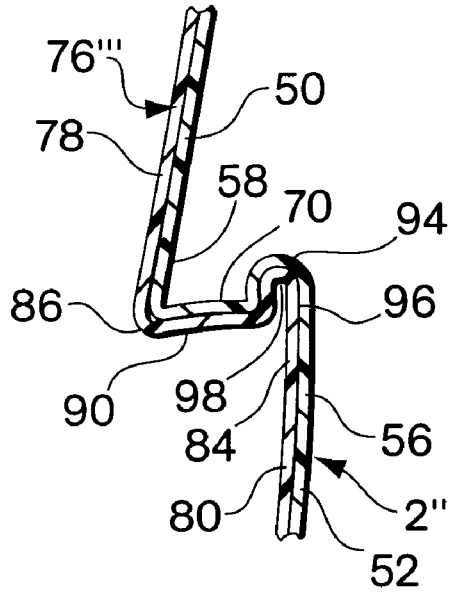
FIG. 10 is a schematic section view, shown partially cut away, of an alternative embodiment of the shoulder of the splicing member and siding panel of FIG. 7, having projections formed on inner edges thereof.

Another embodiment of the shoulder of the splicer having multiple declinations is shown partially broken away and in section in FIG. 10. In this illustrated embodiment, a projection 94, having an inverted U-shaped profile, is formed on a rearward edge of shoulder 70 of splicer 2", connecting shoulder 70 and upper edge 56 of lower declination 52 of splicer 2". Projection 94 forms a downwardly opening channel 96 which receives a projection 98 formed on a rearward edge of shoulder 90 of siding panel 76'''. A siding panel having such a projection 98 is described more fully in detail in commonly owned pending patent application Ser. No. 08/843,872, the entire disclosure of which is incorporated herein by reference. The interaction of projection 98 and channel 96 provides further interlocking engagement between splicer 2'' and siding panel 76'''.

In another preferred embodiment, splicer 2 may comprise three or more declinations, each having a structure corresponding to the declinations of the embodiment shown in FIGS. 1 and 6, with the uppermost declination connected to the flange member, and shoulders extending inwardly from the bottom of each declination.

In a preferred embodiment, siding splicer 2 is manufactured in a post forming process. The first step in a post forming process is the extrusion of a flat sheet in a known extruding manner. The flat sheet is then shaped by calibration to form a desired profile. The extrusion of flat sheets has been found to be a more efficient and faster method than the prior art process of extruding a siding panel with profile tooling. The post forming process thereby can reduce costs, increase efficiency and increase yield in the manufacture of siding panels.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

We claim:

1. A splicing member for securing horizontally adjacent siding panels to one another in an abutting relationship comprising, in combination:

an upper declination having an upper edge and a lower edge;

a flange on the upper declination formed by folding the upper edge of the upper declination outwardly and downwardly from the declination, forming a downwardly opening U-shaped upper channel for receiving a portion of each of a pair of horizontally adjacent siding panels behind which the splicing member is adapted to be positioned;

a lower declination having an upper edge and a lower edge;

an upper shoulder extending inwardly between the lower edge of the upper declination and the upper edge of the lower declination;

a lower shoulder extending inwardly from the lower edge of the lower declination;

wherein the splicing member has a pair of welding surfaces, each welding surface suitable for welding the splicing member to one of a pair of horizontally adjacent siding panels.

2. The splicing member according to claim 1, wherein the upper shoulder extends substantially horizontally.

3. The splicing member according to claim 1, wherein the upper shoulder has a downwardly opening U-shaped lower channel formed along an inner portion thereof to receive projections formed on shoulders of the siding panels.

4. The splicing member according to claim 3, wherein the lower channel is formed between and interconnects the upper shoulder and the upper edge of the lower declination.

5. The splicing member according to claim 1, wherein the lower shoulder has a downwardly opening concave profile.

6. The splicing member according to claim 1, wherein the splicing member and the siding panels are formed of polyvinyl chloride.

7. A splicing member for securing horizontally adjacent siding panels to one another in an abutting relationship comprising, in combination:

a plurality of declinations, each declination having an upper edge and a lower edge;

a flange on the uppermost declination formed by folding the upper edge of the uppermost declination outwardly and downwardly, forming a downwardly opening U-shaped channel for receiving a portion of each of two horizontally adjacent siding panels;

a shoulder extending inwardly and substantially horizontally from the lower edge of each declination;

wherein the splicing member has a pair of welding surfaces, each of the welding surfaces suitable for welding the splicing member to one of two horizontally adjacent siding panels, the splicing member adapted to be positioned behind the siding panels when they are installed.

8. A siding system comprising, in combination:

a pair of horizontally adjacent siding panels, each panel comprising:

an upper panel declination having an upper edge and a lower edge;

a lower panel declination having an upper edge and a lower edge;

an upper panel shoulder extending inwardly between the lower edge of the upper panel declination and the upper edge of the lower panel declination;

a projection formed between an inner edge of the upper panel shoulder and the upper edge of the lower panel declination; and a lower panel shoulder extending inwardly from the lower edge of the lower panel declination and terminating in a lip extending upwardly from an innermost edge of the lower panel shoulder;

a splicing member comprising:

an upper splicing member declination having an upper edge and a lower edge;

a flange connected to the upper edge of the upper splicing member declination forming a downwardly opening upper channel to receive a portion of the siding panels;

a lower splicing member declination having an upper edge and a lower edge;

an upper splicing member shoulder extending inwardly between the lower edge of the upper splicing member declination and the upper edge of the lower splicing member declination;

a downwardly opening lower channel formed between the upper splicing member shoulder and the upper edge of the lower splicing member declination, the downwardly opening lower channel receiving the projections of the siding panels;

a lower splicing member shoulder extending inwardly from the lower edge of the lower splicing member declination;

a pair of welds, each weld securing a portion of the splicing member to one of the siding panels, the splicing member being positioned behind the siding panels when secured thereto; and a retaining member for securing the siding panels to a desired surface.

9. The siding system according to claim 8, wherein the retaining member has a first portion that slidingly engages the siding panels to allow longitudinal movement of the siding panels, and a second portion that is securely fastened to the surface.

10. The siding system according to claim 8, further comprising a flange connected to an upper edge of each siding panel, the fasteners securing the flange of the splicing member to the flanges of the siding panels.

11. The siding system according to claim 10, wherein the flange of each of the siding panels slidingly engages the flange of the splicing member.

12. A siding system comprising, in combination:

a pair of horizontally adjacent siding panels, each panel comprising:

a declination having an upper edge and a lower edge;

a shoulder extending inwardly from the lower edge of the declination and terminating in a lip extending upwardly from an innermost edge of the shoulder; and a splicing member comprising:

a splicing member declination having an upper edge and a lower edge;

a flange connected to the upper edge of the splicing member declination and extending outwardly from the splicing member declination, forming a downwardly opening U-shaped channel to receive a portion of each of the siding panels;

a splicing member shoulder extending inwardly from the lower edge of the splicing member declination; and a pair of welds, each weld securing a portion of the splicing member to one of the siding panels, wherein the splicing member is positioned behind the siding panels and the siding panels are in an abutting relationship.

13. A splicing member for securing horizontally adjacent siding panels to one another in an abutting relationship comprising, in combination:

at least one declination;

a top lock formed by folding an upper edge of an uppermost declination outwardly and downwardly to form a downwardly opening U-shaped channel configured to mate with a portion of each of two horizontally adjacent siding panels;

a bottom lock configured to mate with a portion of each of two horizontally adjacent siding panels; and a pair of fasteners, a first of the fasteners oriented for securing a portion of the splicing member to a first siding panel, and a second of the fasteners oriented for securing a portion of the splicing member to a second siding panel horizontally adjacent and in abutting relationship to the first siding panel when the splicing member is positioned behind the first and second siding panel.

14. The splicing member according to claim 13, wherein the top lock comprises a flange member connected to an upper edge of the uppermost declination and extending outwardly from the uppermost declination, forming a downwardly opening U-shaped upper channel for receiving a portion of each of a pair of horizontally adjacent siding panels behind which the splicing member is positioned.

15. The splicing member according to claim 13, wherein the bottom lock comprises a shoulder extending inwardly from a lower edge of the lowermost declination.

* * * * *